US011757195B2

(12) United States Patent
Huang et al.

(10) Patent No.: US 11,757,195 B2
(45) Date of Patent: Sep. 12, 2023

(54) ANTENNA ELEMENT AND ELECTRONIC DEVICE

(71) Applicant: VIVO MOBILE COMMUNICATION CO., LTD., Guangdong (CN)

(72) Inventors: Huan-Chu Huang, Guangdong (CN); Rongjie Ma, Guangdong (CN); Xianjing Jian, Guangdong (CN); Zhimin Zhu, Guangdong (CN)

(73) Assignee: VIVO MOBILE COMMUNICATION CO., LTD., Guangdong (CN)

( * ) Notice: Subject to any disclaimer, the term of this patent is extended or adjusted under 35 U.S.C. 154(b) by 99 days.

(21) Appl. No.: 17/531,603

(22) Filed: Nov. 19, 2021

(65) Prior Publication Data

US 2022/0085511 A1 Mar. 17, 2022

Related U.S. Application Data

(63) Continuation of application No. PCT/CN2020/090051, filed on May 13, 2020.

(30) Foreign Application Priority Data

May 22, 2019 (CN) ..... 201910430954.9

(51) Int. Cl.
*H01Q 9/06* (2006.01)
*H01Q 19/18* (2006.01)
(Continued)

(52) U.S. Cl.
CPC ..... *H01Q 9/065* (2013.01); *H01Q 1/523* (2013.01); *H01Q 5/45* (2015.01); *H01Q 5/48* (2015.01); *H01Q 19/18* (2013.01); *H01Q 21/24* (2013.01)

(58) Field of Classification Search
CPC ..... H01Q 9/065; H01Q 19/18; H01Q 1/523; H01Q 5/45; H01Q 5/48; H01Q 21/24;
(Continued)

(56) References Cited

U.S. PATENT DOCUMENTS 6,326,922 B1 * 12/2001 Hegendoerfer ..... H01Q 1/38 343/803
6,567,055 B1 5/2003 Oglesby
(Continued)

FOREIGN PATENT DOCUMENTS

CN 101599578 A 12/2009
CN 104901004 A 9/2015
(Continued)

OTHER PUBLICATIONS

Waleed El-Halwagy et al., Fence Shaping of Substrate Integrated Fan-Beam Electric Dipole for High-Band 5G, Electronics, vol. 8, No. 5, May 15, 2019, pp. 1-9, XP055926747.
(Continued)

*Primary Examiner* — Vibol Tan
(74) *Attorney, Agent, or Firm* — IP & T GROUP LLP

(57) ABSTRACT

An antenna element antenna element includes: a substrate, having a ground plate; a vertically polarized dipole antenna, including a first antenna branch and a second antenna branch, where the first antenna branch and the second antenna branch are disposed in the substrate at an interval; a reflector, including several reflection pillars, where the several reflection pillars are sequentially arranged in the substrate at intervals along a parabola; and a first feeding structure, where the first antenna branch and the second antenna branch are electrically connected to the ground plate via the first feeding structure.

18 Claims, 14 Drawing Sheets

(51) Int. Cl.

| | |
|---|---|
| ***H01Q 21/24*** | (2006.01) |
| ***H01Q 5/45*** | (2015.01) |
| ***H01Q 5/48*** | (2015.01) |
| ***H01Q 1/52*** | (2006.01) |

(58) Field of Classification Search
CPC ..... H01Q 19/30; H01Q 1/36; H01Q 1/38; H01Q 1/48; H01Q 1/50; H01Q 19/13
See application file for complete search history.

(56) References Cited

U.S. PATENT DOCUMENTS

| | | | | |
|---|---|---|---|---|
| 8,502,746 | B2 * | 8/2013 | Huang | H01Q 9/285 343/819 |
| 9,368,874 | B2 * | 6/2016 | Kim | H01Q 1/286 |
| 10,224,644 | B1 * | 3/2019 | Park | H01Q 21/065 |
| 2006/0061513 | A1 | 3/2006 | Sato | |
| 2011/0063187 | A1 | 3/2011 | Huang | |
| 2016/0149314 | A1 | 5/2016 | Helander et al. | |

FOREIGN PATENT DOCUMENTS

| | | | |
|---|---|---|---|
| CN | 107078393 | A | 8/2017 |
| CN | 109301461 | A | 2/2019 |
| CN | 110148828 | A | 8/2019 |
| TW | 201110463 | A1 | 3/2011 |

OTHER PUBLICATIONS

Huan-Chu Huang et al., A Simple Planar High-Directivity Yagi-Uda Antenna with a Concave Parabolic Reflector, Antenna Technology (IWAT), 2010 International Workshop on, Mar. 1, 2010, pp. 1-4, XP031676483, IEEE.

Tzu-Chien Huang et al., End-Fire Quasi-Yagi Antennas with Pattern Diversity on LTCC Technology for 5G Mobile Communications, 2016 IEEE International Symposium on Radio-Frequency Integration Technology (RFIT), Aug. 24, 2016, pp. 1-3, XP032971235, IEEE.

Extended European Search Report for European Patent Application No. 20809670.1 issued by the European Patent Office dated Jun. 14, 2022.

International Search Report of International Application No. PCT/CN2020/090051 dated Aug. 13, 2020.

Written Opinion of the International Searching Authority of International Application No. PCT/CN2020/090051 dated Aug. 13, 2020.

First Office Action of Priority Application No. 201910430954.9 dated Jun. 2, 2020.

The Second Office Action of Priority Application No. 201910430954.9 dated Jan. 5, 2021.

* cited by examiner

ANTENNA ELEMENT AND ELECTRONIC DEVICE

CROSS-REFERENCE TO RELATED APPLICATIONS

This application is a Bypass Continuation Application of PCT/CN2020/090051, filed on May 13, 2020, which claims priority to Chinese Patent Application No. 201910430954.9 filed on May 22, 2019, which are incorporated herein by reference in their entirety.

TECHNICAL FIELD

The present disclosure relates to the field of antenna technologies, and in particular, to an antenna element and an electronic device.

BACKGROUND

Currently, antennae mainly include patch antennae, Yagi-Uda antennae, dipole antennae, and the like. Requirements for beam transmission performance of an antenna vary depending on scenarios. For example, in some scenarios, the antenna is required to have relatively wide radiation performance; but in some other scenarios, the antenna is required to have high-directivity radiation performance, that is, the antenna is required to have relatively high end-fire performance.

SUMMARY

Embodiments of the present disclosure provide an antenna element and an electronic device.

According to a first aspect, an embodiment of the present disclosure provides an antenna element, including:

a substrate, where the substrate has a ground plate;

a vertically polarized dipole antenna, where the vertically polarized dipole antenna includes a first antenna branch and a second antenna branch, and the first antenna branch and the second antenna branch are disposed in the substrate at an interval;

a reflector, where the reflector includes several reflection pillars, and the several reflection pillars are sequentially arranged in the substrate at intervals along a parabola; and a first feeding structure, where the first antenna branch and the second antenna branch are electrically connected to the ground plate via the first feeding structure, where the first antenna branch and the second antenna branch are both disposed on a focus side of the parabola.

According to a second aspect, an embodiment of the present disclosure provides an electronic device, including the antenna element provided in the first aspect of the embodiments of the present disclosure.

BRIEF DESCRIPTION OF DRAWINGS

To describe the technical solutions in embodiments of the present disclosure more clearly, the following briefly describes the accompanying drawings required for describing the embodiments of the present disclosure. Apparently, the accompanying drawings in the following description show merely some embodiments of the present disclosure, and a person of ordinary skill in the art may still derive other drawings from these accompanying drawings.

DETAILED DESCRIPTION OF EMBODIMENTS

Figure 1:
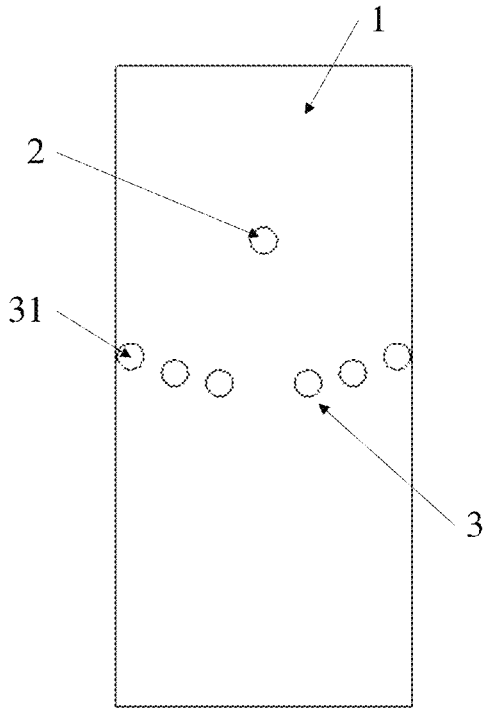
FIG. 1 is a schematic diagram of an external structure of an antenna element according to an embodiment of the present disclosure.

The following clearly describes the technical solutions in the embodiments of the present disclosure with reference to the accompanying drawings in the embodiments of the present disclosure. Apparently, the described embodiments are some rather than all of the embodiments of the present disclosure. All other embodiments obtained by a person of ordinary skill in the art based on the embodiments of the present disclosure shall fall within the protection scope of the present disclosure.

As shown in FIGS. 1 to 9 and FIGS. 16 to 21, embodiments of the present disclosure provide an antenna element, including:

a substrate 1, where the substrate 1 has a ground plate 11;

a vertically polarized dipole antenna 2, where the vertically polarized dipole antenna 2 includes a first antenna branch 21 and a second antenna branch 22, and the first antenna branch 21 and the second antenna branch 22 are disposed in the substrate 1 at an interval;

a reflector 3, where the reflector 3 includes several reflection pillars 31, and the several reflection pillars 31 are sequentially arranged in the substrate 1 at intervals along a parabola; and a first feeding structure 4, where the first antenna branch 21 and the second antenna branch 22 are electrically connected to the ground plate 11 via the first feeding structure 4, where the first antenna branch 21 and the second antenna branch 22 are both disposed on a focus side of the parabola; and the first antenna branch 21 and the second antenna branch 22 of the vertically polarized dipole antenna 2 are both vertically disposed in the substrate 1. Optionally, the first antenna branch 21 and the second antenna branch 22 may be disposed in the substrate 1 in a direction perpendicular to the substrate 1, or in another direction slightly deviating from the direction perpendicular to the substrate 1. The central axis of the first antenna branch 21 and the central axis of the second antenna branch 22 may completely coincide with each other, or be slightly staggered with each other by a certain angle, or slightly deviate from each other by a certain distance. The length of the first antenna branch 21 and the length of the second antenna branch 22 may be equal or approximately equal. The lengths of the first antenna branch 21 and the second antenna branch 22 are approximately a quarter of a wavelength in a medium.

The foregoing reflector 3 is used as a reflector of the vertically polarized dipole antenna 2. The disposing direction of each reflection pillar 31 in the substrate 1 needs to match the disposing directions of the first antenna branch 21 and the second antenna branch 22. In this way, each reflection pillar 31 also needs to be vertically disposed in the substrate 1. Optionally, each reflection pillar 31 may be disposed in the substrate 1 in a direction perpendicular to the substrate 1, or in another direction slightly deviating from the direction perpendicular to the substrate 1.

In this embodiment of the present disclosure, the vertically polarized dipole antenna 2 and the reflector 3 that is arranged along the parabola are disposed in the substrate 1, and the vertically polarized dipole antenna 2 is disposed on the focus side of the parabola, so that most beams of the vertically polarized dipole antenna 2 radiate towards a front end, and radiation towards a back end is reduced, thereby enhancing the end-fire performance of the dipole antenna.

Owing to relatively high end-fire performance, the antenna element in this embodiment of the present disclosure may be set to a millimeter-wave antenna element, thereby being adapted to transmission of signals in 5G millimeter-wave bands. In other words, the vertically polarized dipole antenna 2 may be a millimeter-wave antenna. The lengths of the first antenna branch 21 and the second antenna branch 22 of the vertically polarized dipole antenna 2 may be set based on a millimeter-wave wavelength.

Optionally, the central axis of the first antenna branch 21 and the central axis of the second antenna branch 22 both penetrate the focus of the parabola. In this way, a gain of the vertically polarized dipole antenna 2 and a front-to-back ratio of a radiation pattern of the vertically polarized dipole antenna 2 can be increased.

It should be noted that, in a case that the ground plate 11 is disposed in a partial area of the substrate 1, for example, a left-side area of the substrate 1, a right-side area of the substrate 1 is a clearance area 12. The entire reflector 3 may be disposed in the area where the ground plate 11 is located. The first antenna branch 21 and the second antenna branch 22 may be both disposed in the clearance area 12. The first feeding structure 4 extends from the clearance area 12 to the area where the ground plate 11 is located.

Optionally, the entire reflector 3 is disposed in an edge area of the ground plate 11 close to the clearance area 12. In this way, in one aspect, the distance between the reflector 3 and the vertically polarized dipole antenna 2 can be shortened, thereby improving a reflection effect of the reflector 3 on the vertically polarized dipole antenna 2, and increasing the front-to-back ratio of the radiation pattern of the vertically polarized dipole antenna 2. In another aspect, horizontal space of the ground plate 11 occupied by the entire reflector 3 can be reduced, thereby reserving more space of the ground plate 11 for other components.

Optionally, reflection pillars 31 on two sides of the reflector 3 are located at a junction of the ground plate 11 and the clearance area 12. In other words, some of the reflection pillars 31 on the two sides of the reflector 3 are located in the area where the ground plate 11 is located, and the other reflection pillars 31 are located in the clearance area 12.

Figure 3:
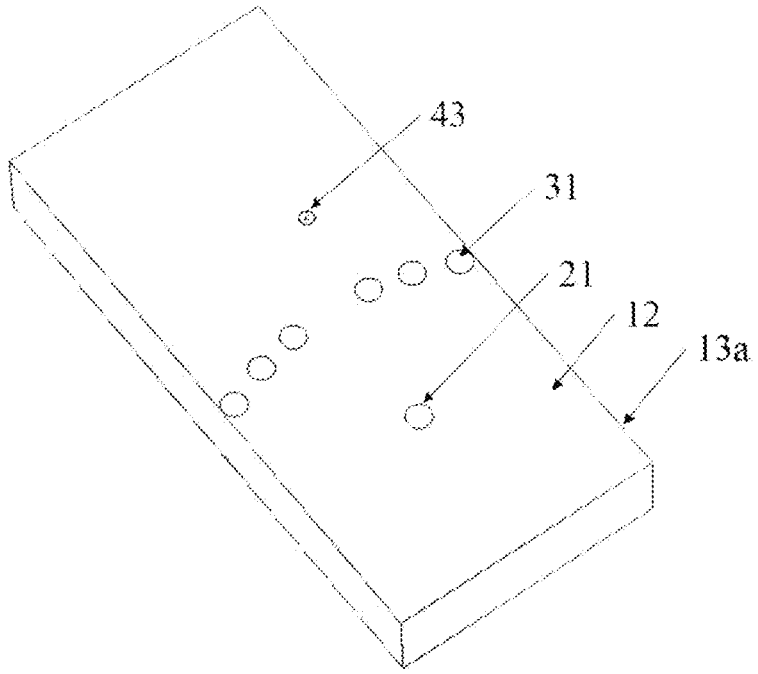
FIG. 3 to FIG. 7 are schematic diagrams of a breakdown structure of an antenna element according to an embodiment of the present disclosure.
Figure 4:
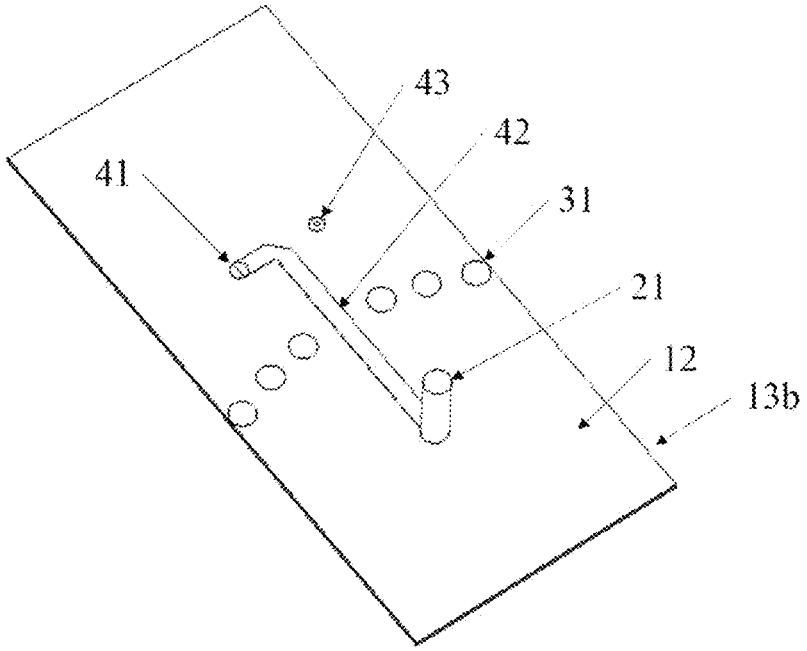
Figure 5:
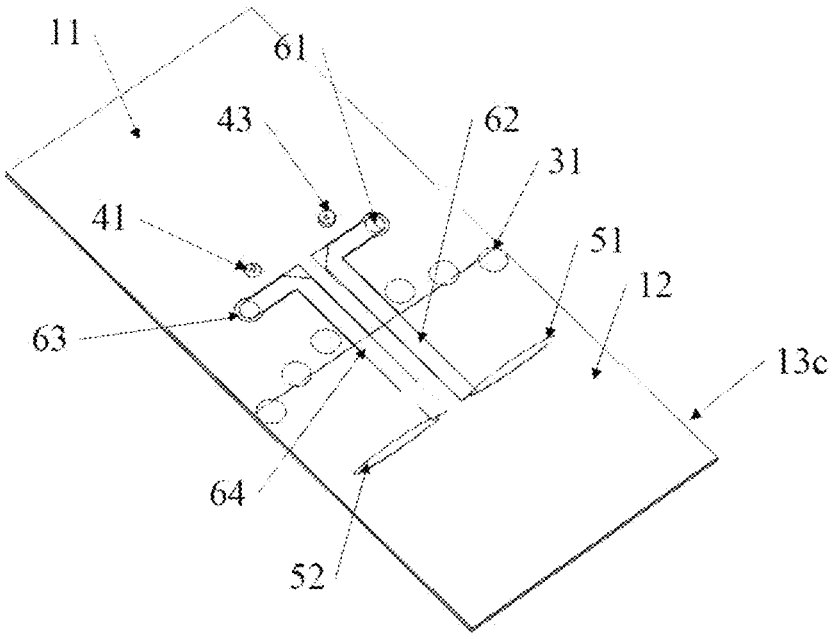

Distances between adjacent reflection pillars 31 of the reflector 3 may be completely equal to one another, or partially equal to one another. To improve the reflection effect of the reflector 3, the distances between the adjacent reflection pillars 31 cannot be too large. In a case that space between two adjacent reflection pillars 31 of the reflector 3 needs to allow a related component to penetrate, the distance between the two adjacent reflection pillars 31 may be appropriately increased, and the distances between the other adjacent reflection pillars 31 may be accordingly reduced. FIGS. 1 and 3 and other figures show an implementation in which the distance between two adjacent reflection pillars 31 in the middle of the reflector 3 is larger, and the distances between the other adjacent reflection pillars 31 of the reflector 3 are all equal.

The following describes disposing methods of each component of the antenna element.

Figure 2:
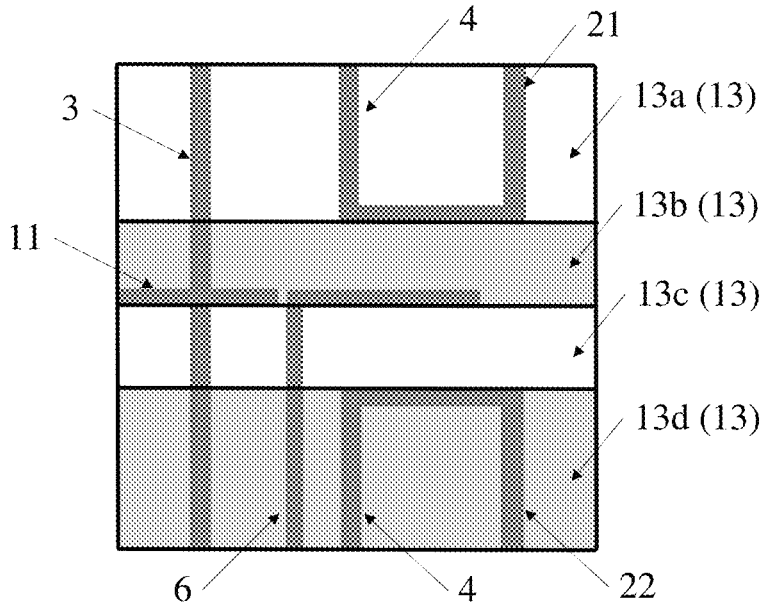
FIG. 2 is a schematic diagram of a cross-section structure of an antenna element according to an embodiment of the present disclosure.
Figure 16:
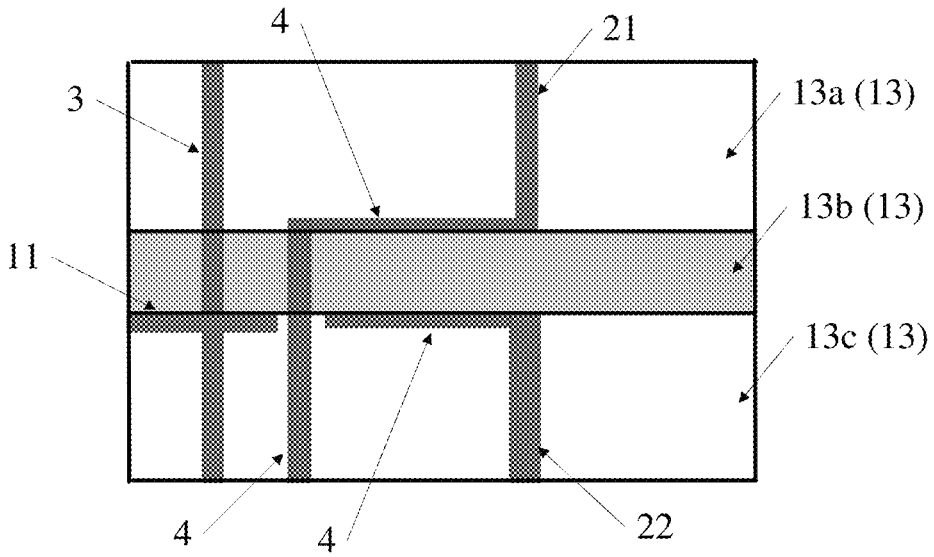
FIG. 16 is a schematic diagram of a cross-section structure of another antenna element according to an embodiment of the present disclosure.
Figure 17:
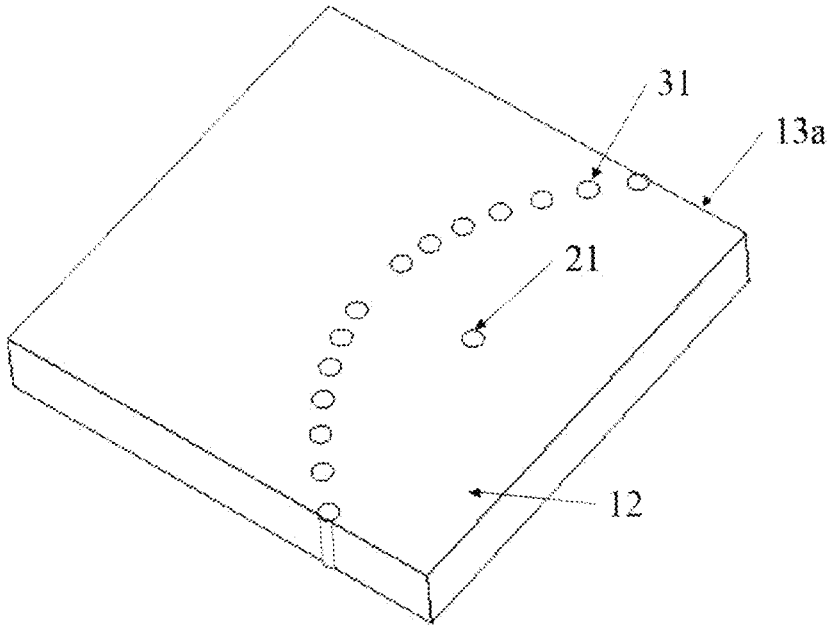
FIG. 17 to FIG. 20 are schematic diagrams of a breakdown structure of another antenna element according to an embodiment of the present disclosure.
Figure 18:
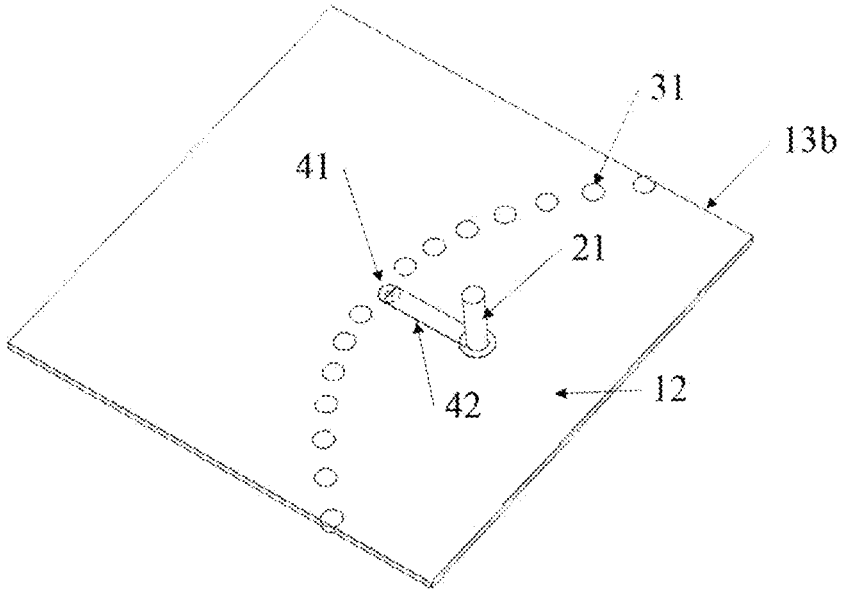
Figure 19:
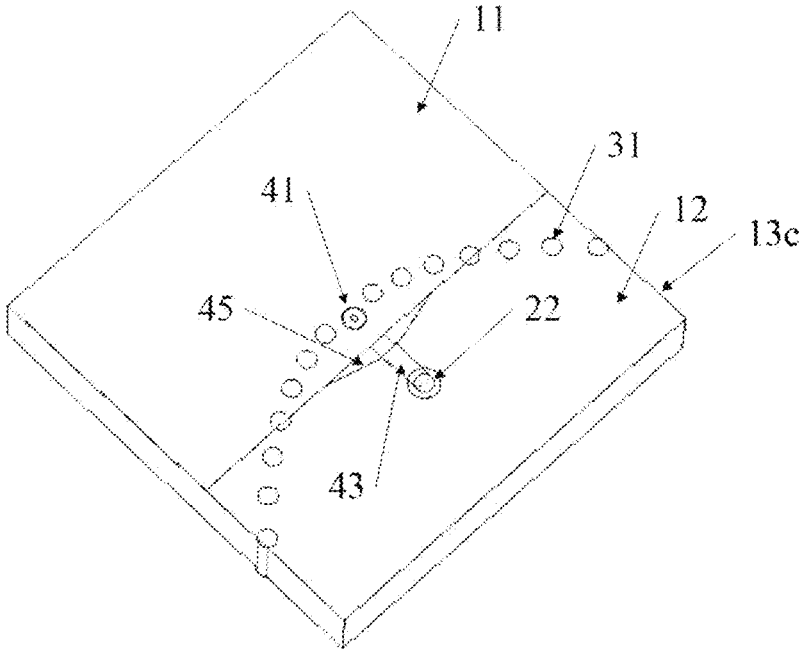
Figure 20:
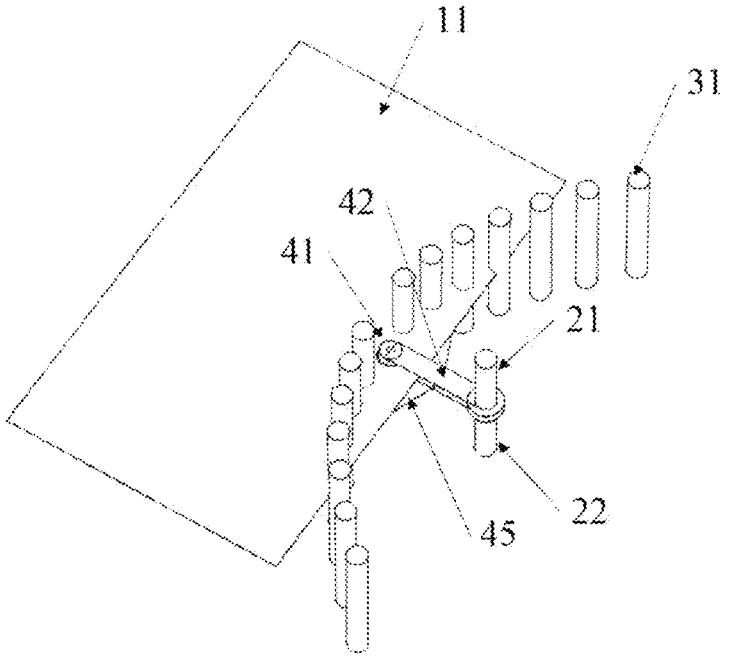

Optionally, as shown in FIGS. 2 and 16, the substrate 1 includes N dielectric plates 13, where N is greater than or equal to 3.

The first antenna branch 21 and the second antenna branch 22 are respectively disposed in two non-adjacent dielectric plates 13, and the first antenna branch 21 and the second antenna branch 22 respectively penetrate the dielectric plates 13.

The entire reflector 3 penetrates the N dielectric plates 13.

Optionally, all the reflection pillars 31 of the reflector 3 penetrate the N dielectric plates 13.

As the substrate 1 includes a plurality of dielectric plates 13, the first antenna branch 21, the second antenna branch 22, and the reflector 3 can be formed by separately processing corresponding dielectric plates 13. In this way, a manufacturing process of the antenna element can be simplified. In addition, as the substrate 1 includes the plurality of dielectric plates 13, the lengths of the first antenna branch 21, the second antenna branch 22, and the reflection pillars 31 and the distance between the first antenna branch 21 and the second antenna branch 22 can be conveniently controlled. Particularly, the lengths of the first antenna branch 21 and the second antenna branch 22 can be controlled more precisely, thereby being approximately a quarter of a wavelength in a medium as far as possible, and further improving performance of the antenna element.

In addition, each reflection pillar 31 of the reflector 3 penetrates the N dielectric plates 13, so that the vertically polarized dipole antenna 2 is located in a reflection area of the reflector 3, thereby further improving the reflection effect.

FIG. 2 shows an implementation in which the substrate 1 includes four dielectric plates 13, the first antenna branch 21 is disposed in a first dielectric plate 13*a*, and the second antenna branch 22 is disposed in a fourth dielectric plate 13*d*. FIG. 16 shows an implementation in which the substrate 1 includes three dielectric plates 13, the first antenna branch 21 is disposed in a first dielectric plate 13*a*, and the second antenna branch 22 is disposed in a third dielectric plate 13*c*.

Optionally, the first antenna branch 21 and the second antenna branch 22 are respectively formed by metal pillars that penetrate the corresponding dielectric plates 13.

All the reflection pillars 31 of the reflector 3 are formed by several metal pillars penetrating the N dielectric plates 13.

Optionally, the dielectric plates 13 corresponding to the first antenna branch 21 and the second antenna branch 22 are both provided with through holes (not shown in the figures) perpendicularly penetrating the dielectric plates 13, and the first antenna branch 21 and the second antenna branch 22 are formed by metal pillars with which the through holes are filled. Several through holes perpendicularly penetrating the N dielectric plates 13 are formed in the N dielectric plates 13 along a parabola. All the reflection pillars 31 of the reflector 3 are formed by metal pillars penetrating the several through holes.

The first antenna branch 21, the second antenna branch 22, and the reflection pillars 31 are formed by punching holes in the dielectric plates 13 and disposing metal pillars in the holes. Therefore, the process is simple and mature, and nearly no additional production cost is added.

The antenna element in this embodiment of the present disclosure may be provided with only the vertically polarized dipole antenna, thereby being used as a single-polarized dipole antenna. The antenna element in this embodiment of the present disclosure may also be set to a dual-polarized dipole antenna. The following describes implementations of the dual-polarized dipole antenna.

As shown in FIGS. 2 to 9, the antenna element includes:

a substrate 1, where the substrate 1 has a ground plate 11;

a vertically polarized dipole antenna 2, where the vertically polarized dipole antenna 2 includes a first antenna branch 21 and a second antenna branch 22, and the first antenna branch 21 and the second antenna branch 22 are disposed in the substrate 1 at an interval;

a horizontally polarized dipole antenna 5, where the horizontally polarized dipole antenna 5 includes a third antenna branch 51 and a fourth antenna branch 52, and the third antenna branch 51 and the fourth antenna branch 52 are disposed in the substrate 1 at an interval;

a reflector 3, where the reflector 3 includes several reflection pillars 31, and the several reflection pillars 31 are sequentially arranged in the substrate 1 at intervals along a parabola;

a first feeding structure 4, where the first antenna branch 21 and the second antenna branch 22 are electrically connected to the ground plate 11 via the first feeding structure 4; and a second feeding structure 6, where the third antenna branch 51 and the fourth antenna branch 52 are electrically connected to the ground plate 11 via the second feeding structure 6.

The first antenna branch 21, the second antenna branch 22, the third antenna branch 51, and the fourth antenna branch 52 are all disposed on a focus side of the parabola.

The first antenna branch 21 and the second antenna branch 22 are respectively disposed on two sides of a plane where the third antenna branch 51 and the fourth antenna branch 52 are located, and the third antenna branch 51 and the fourth antenna branch 52 are respectively disposed on two sides of a plane where the first antenna branch 21 and the second antenna branch 22 are located.

The first antenna branch 21 and the second antenna branch 22 of the vertically polarized dipole antenna 2 are both vertically disposed in the substrate 1. Optionally, the first antenna branch 21 and the second antenna branch 22 may be disposed in the substrate 1 in a direction perpendicular to the substrate 1, or in another direction slightly deviating from the direction perpendicular to the substrate 1. The central axis of the first antenna branch 21 and the central axis of the second antenna branch 22 may completely coincide with each other, or be slightly staggered with each other by a certain angle, or slightly deviate from each other by a certain distance. The length of the first antenna branch 21 and the length of the second antenna branch 22 may be equal or approximately equal. The lengths of the first antenna branch 21 and the second antenna branch 22 are approximately a quarter of a wavelength in a medium.

The third antenna branch 51 and the fourth antenna branch 52 of the horizontally polarized dipole antenna 5 are both transversely (or horizontally) disposed in the substrate 1. Optionally, the third antenna branch 51 and the fourth antenna branch 52 may be disposed in the substrate 1 in a direction parallel to the substrate 1, or in another direction slightly deviating from the direction parallel to the substrate 1. The central axis of the third antenna branch 51 and the central axis of the fourth antenna branch 52 may completely coincide with each other, or be slightly staggered with each other by a certain angle, or slightly deviate from each other by a certain distance. The length of the third antenna branch 51 and the length of the fourth antenna branch 52 may be equal or approximately equal. The lengths of the third antenna branch 51 and the fourth antenna branch 52 are approximately a quarter of a wavelength in a medium.

In the horizontally polarized dipole antenna 5, the third antenna branch 51 and the fourth antenna branch 52 may be rectangular, triangular or oval. Because shape changes of an oval are relatively gentle, when the third antenna branch 51 and the fourth antenna branch 52 are oval, impedance changes of the antenna are relatively gentle, which is conducive to expansion of a bandwidth of the horizontally polarized dipole antenna 5.

It should be noted that, in a case that the ground plate 11 is disposed in a partial area of the substrate 1, for example, the left-side area of the substrate 1, and the right-side area of the substrate 1 is the clearance area 12. The entire reflector 3 may be disposed in the area where the ground plate 11 is located. The first antenna branch 21, the second antenna branch 22, the third antenna branch 51, and the fourth antenna branch 52 may be all disposed in the clearance area 12. The first feeding structure 4 and the second feeding structure 6 extend from the clearance area 12 to the area where the ground plate 11 is located.

The reflector 3 is used as a reflector of the vertically polarized dipole antenna 2, while a reflector of the horizontally polarized dipole antenna 5 may use the ground plate 11 of the substrate 1, that is, the ground plate 11 of the substrate 1 may be used as the reflector of the horizontally polarized dipole antenna 5. To achieve a better reflection effect, the third antenna branch 51 and the fourth antenna branch 52 of the horizontally polarized dipole antenna 5 may be disposed on a plane where the ground plate 11 of the substrate 1 is disposed.

In this embodiment of the present disclosure, a vertically polarized dipole antenna and a horizontally polarized dipole antenna are combined, to implement design of a dual-polarized dipole antenna. In one aspect, a multiple-input multiple-output (MIMO) function can be implemented, thereby increasing a data transmission rate. In another aspect, a wireless diversity connection capability of the antenna can be improved, thereby reducing a probability of communication disconnection, and improving communication effects and user experience.

In this embodiment of the present disclosure, because the vertically polarized dipole antenna 2 and the horizontally polarized dipole antenna 5 are staggered in a vertical direction (namely, a direction perpendicular to the substrate 1), a position relationship between the vertically polarized dipole antenna 2 and the horizontally polarized dipole antenna 5 in a horizontal direction (namely, a direction parallel to the substrate 1) may not be limited. For example, the vertically polarized dipole antenna 2 may be disposed in an area between the horizontally polarized dipole antenna 5 and the reflector 3; or the horizontally polarized dipole antenna 5 may be disposed in an area between the vertically polarized dipole antenna 2 and the reflector 3; or the vertically polarized dipole antenna 2 and the horizontally polarized dipole antenna 5 are disposed on a same vertical plane.

Figure 7:
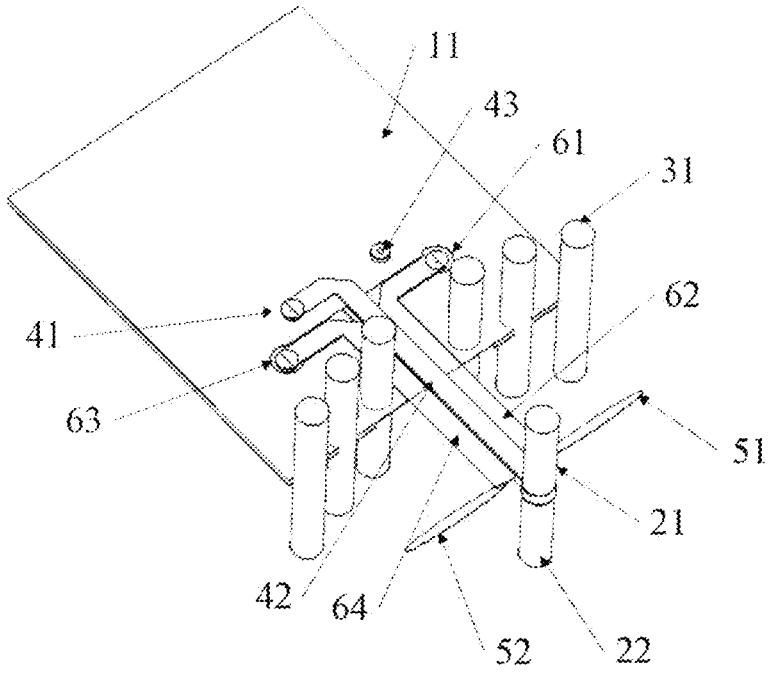
Figure 8:
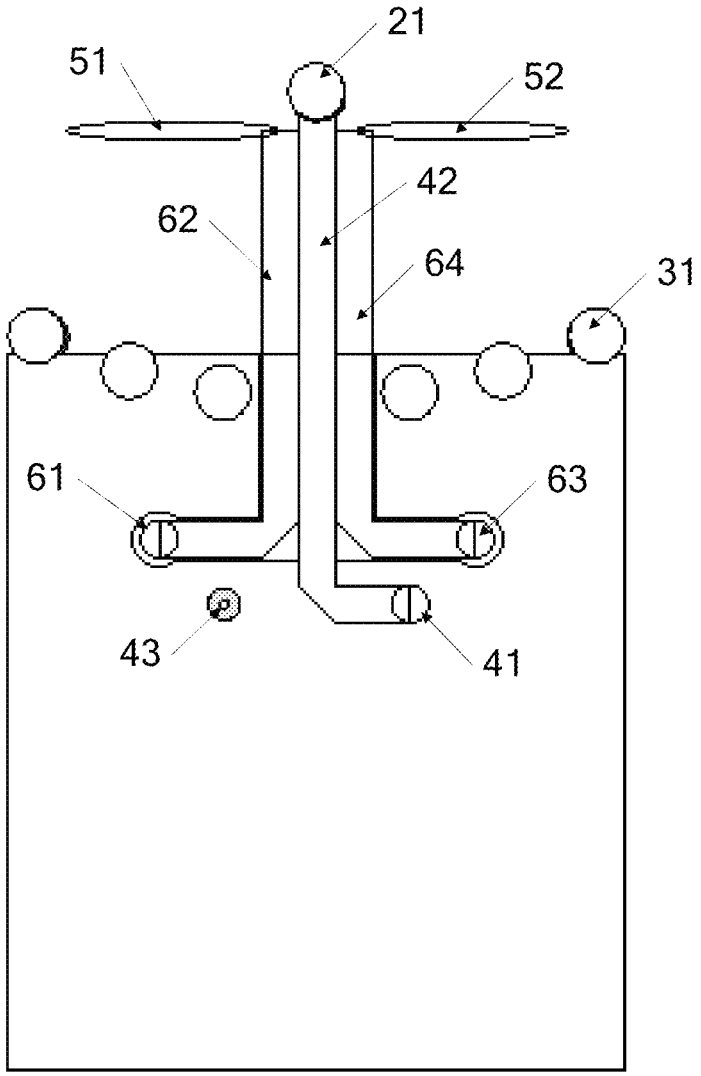
FIG. 8 is a schematic top view of an internal structure of an antenna element according to an embodiment of the present disclosure.
Figure 9:
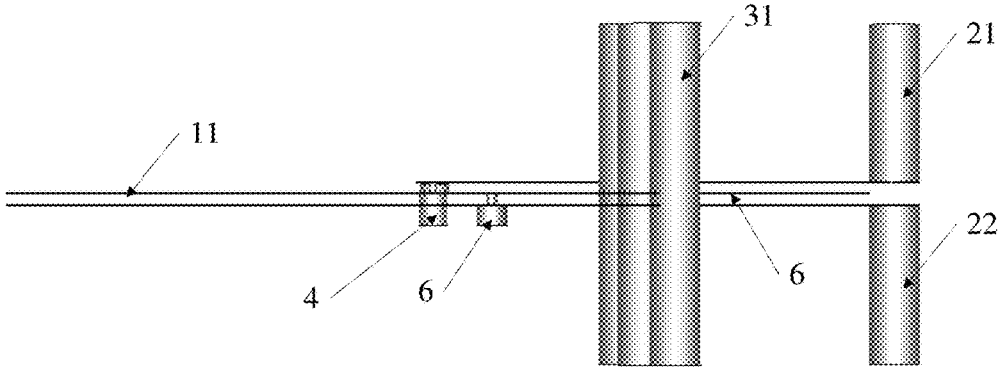
FIG. 9 is a schematic side view of an internal structure of an antenna element according to an embodiment of the present disclosure.

FIGS. 7 and 8 show an implementation in which the third antenna branch 51 and the fourth antenna branch 52 are both disposed in an area between the vertically polarized dipole antenna 2 and the reflector 3. In this implementation, space of the clearance area 12 occupied by the horizontally polarized dipole antenna 5 and the vertically polarized dipole antenna 2 can be reduced.

As mentioned above, the antenna element in this embodiment of the present disclosure may be set to a millimeter-wave antenna element, that is, the vertically polarized dipole antenna 2 and the horizontally polarized dipole antenna 5 are both millimeter-wave antennae.

Globally mainstream 5G millimeter-wave frequency bands defined by 3rd generation partnership project (3GPP) include n258 (24.25 GHz to 27.5 GHz) principally being 26 GHz, n257 (26.5 GHz to 29.5 GHz) principally being 28 GHz, n261 (27.5 GHz to 28.35 GHz) principally being 28 GHz, and n260 (37.0 GHz to 40.0 GHz) principally being 39 GHz.

Figure 10:
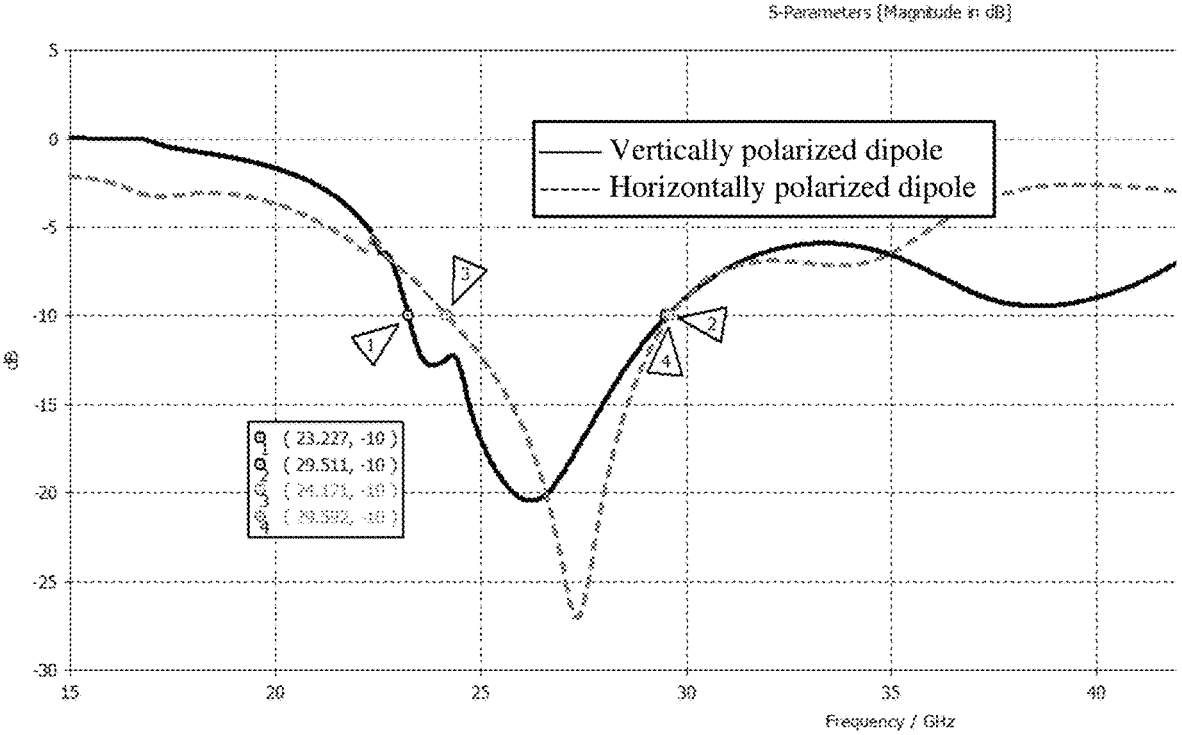
FIG. 10 is a simulated diagram of a reflection coefficient of an antenna element according to an embodiment of the present disclosure.
Figure 11:
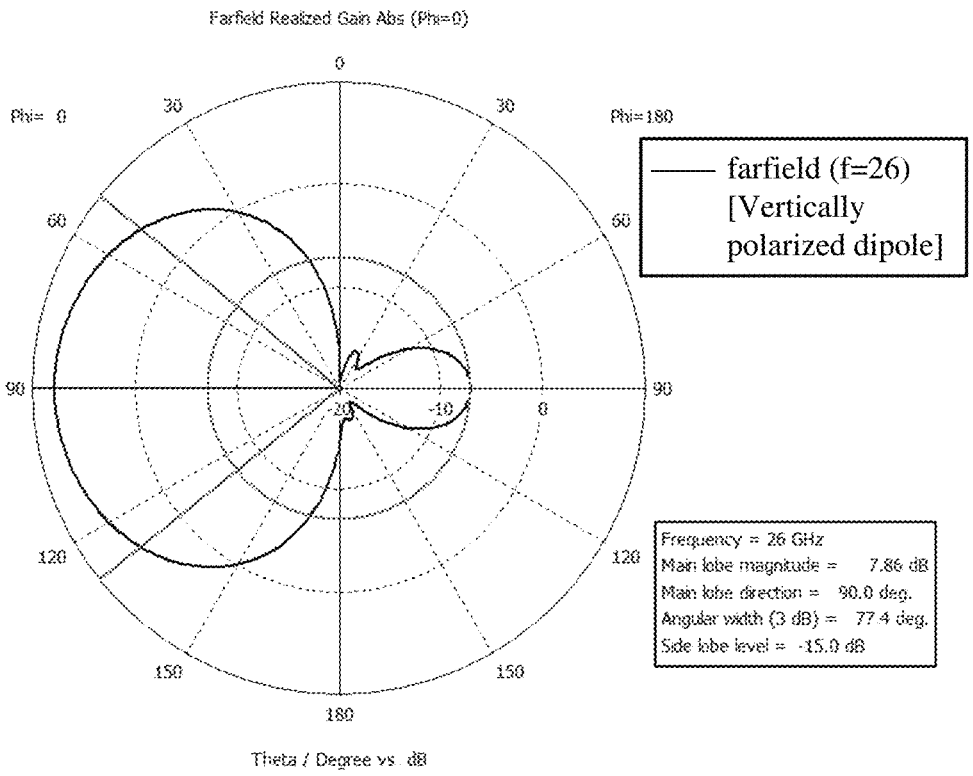
FIG. 11 is a radiation pattern of a 26 GHz vertically polarized dipole of an antenna element according to an embodiment of the present disclosure.
Figure 12:
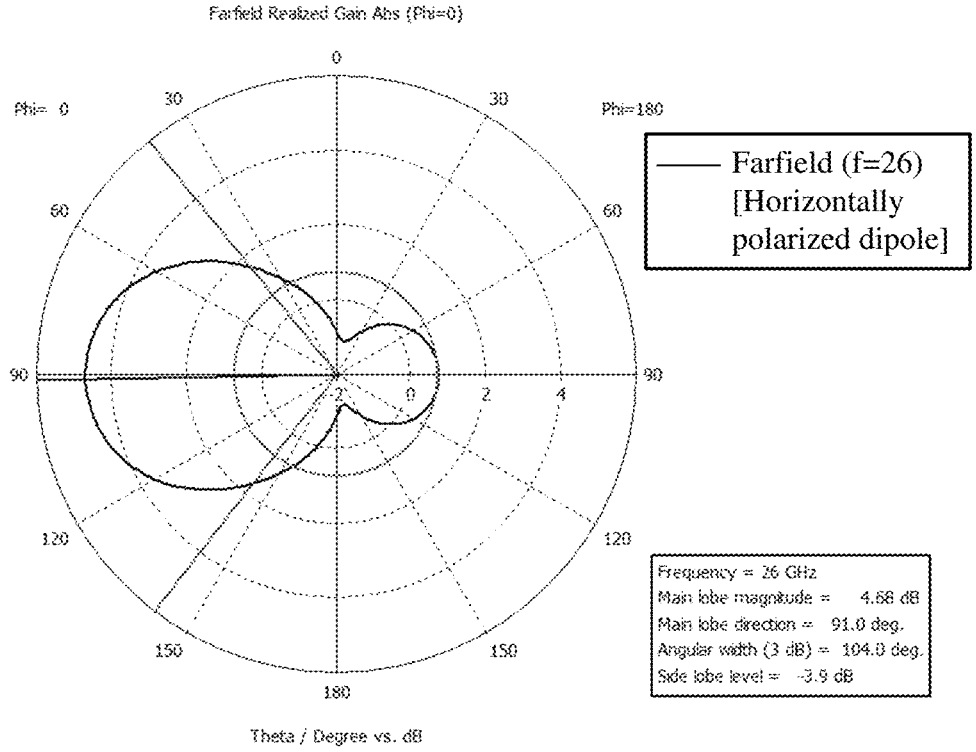
FIG. 12 is a radiation pattern of a 26 GHz horizontally polarized dipole of an antenna element according to an embodiment of the present disclosure.
Figure 13:
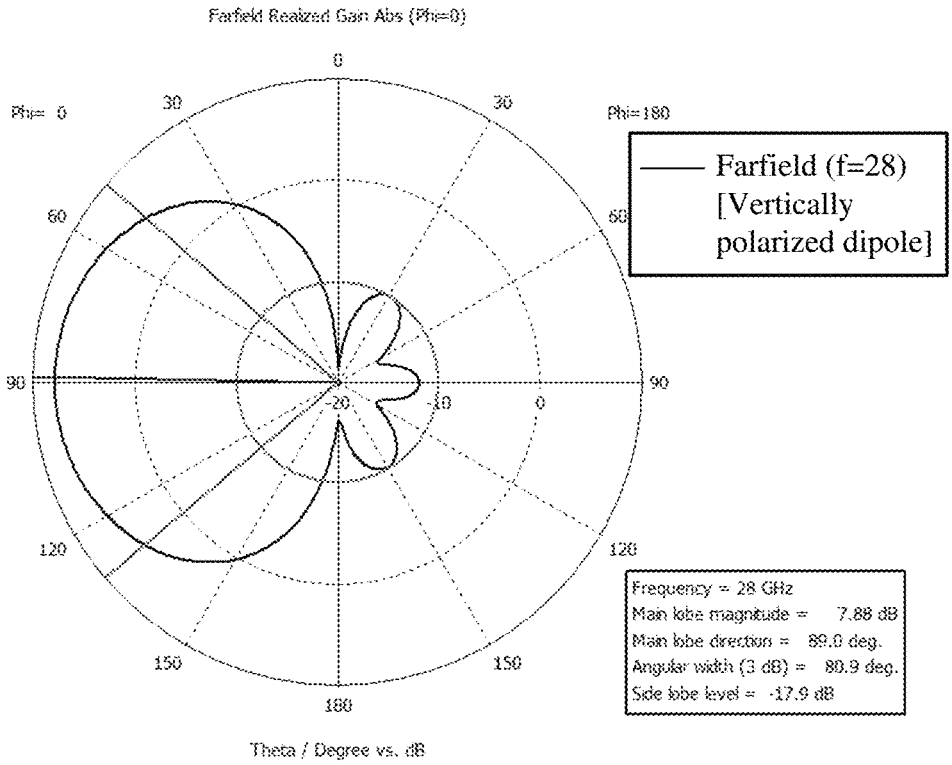
FIG. 13 is a radiation pattern of a 28 GHz vertically polarized dipole of an antenna element according to an embodiment of the present disclosure.
Figure 14:
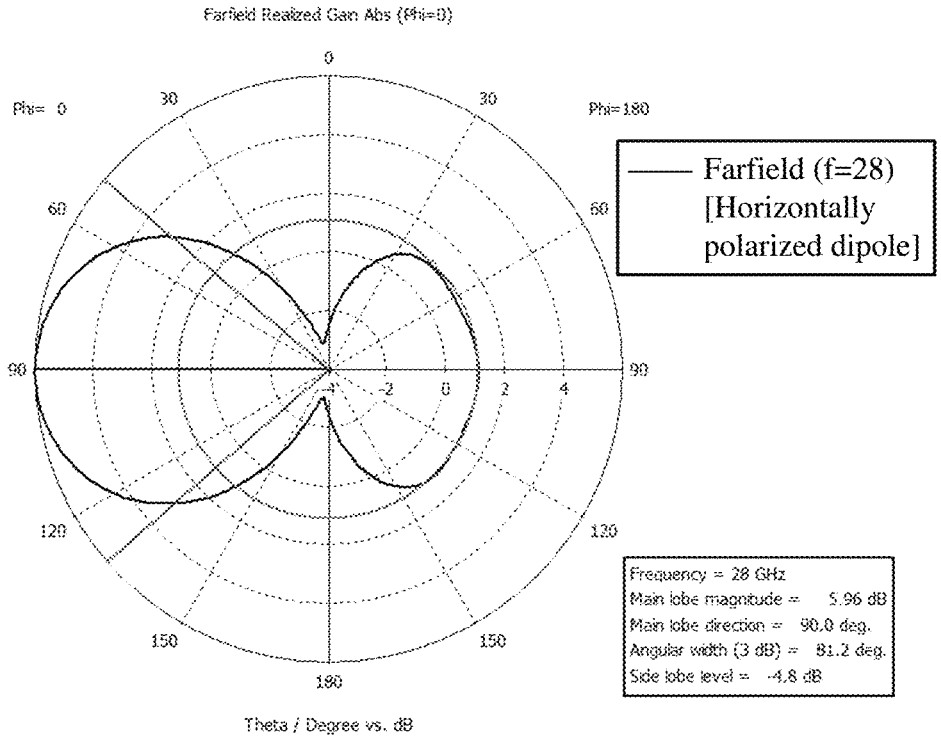
FIG. 14 is a radiation pattern of a 28 GHz horizontally polarized dipole of an antenna element according to an embodiment of the present disclosure.
Figure 15:
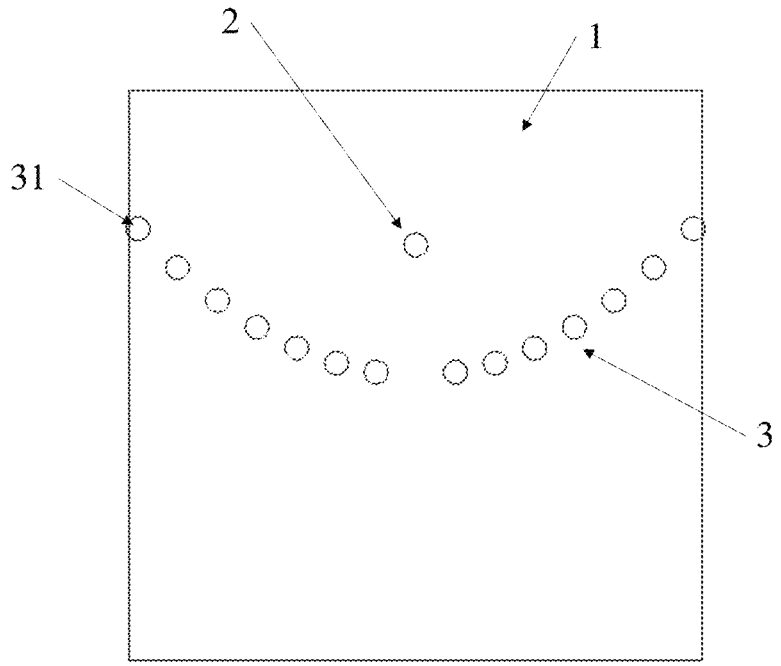
FIG. 15 is a schematic diagram of an external structure of another antenna element according to an embodiment of the present disclosure.

Assuming that a reference frequency of the vertically polarized dipole antenna 2 and the horizontally polarized dipole antenna 5 is 28.0 GHz, it can be learned from the reflection coefficient diagram shown in FIG. 10 that, a common bandwidth of the horizontally polarized dipole antenna and the vertically polarized dipole antenna range from 24.17 GHz to 29.51 GHz when their S parameters are −10 dB, thereby basically covering the globally mainstream 5G millimeter-wave frequency bands: n257, n258, and n261.

Optionally, the first antenna branch 21 and the second antenna branch 22 are symmetrical to each other about a plane where the third antenna branch 51 and the fourth antenna branch 52 are disposed.

The third antenna branch 51 and the fourth antenna branch 52 are symmetrical to each other about a plane where the first antenna branch 21 and the second antenna branch 22 are disposed.

It can be learned from the entire structure that, the two antenna branches of the horizontally polarized dipole antenna are inserted into a middle position between the two antenna branches of the vertically polarized dipole antenna, and the two antenna branches of the vertically polarized dipole antenna are inserted into a middle position between the two antenna branches of the horizontally polarized dipole antenna. Therefore, the entire structure is kept strictly symmetrical in a horizontal direction and a vertical direction, which can prevent angle offset of the radiation patterns in a primary radiation direction.

FIGS. 11 to 14 respectively show radiation patterns of the dual-polarized dipole antenna at frequencies of 26.0 GHz and 28.0 GHz. It can be learned from these figures that the radiation patterns are all end-fire radiation patterns with less back-end radiation.

The following describes disposing methods of related feeding structures of the antenna element.

As shown in FIGS. 3 to 9, the first feeding structure 4 includes:

- a first feeding point 41, where the first feeding point 41 is electrically connected to the ground plate 11;
- a first feeder 42, where one end of the first feeder 42 is electrically connected to the first antenna branch 21, and the other end of the first feeder 42 is electrically connected to the first feeding point 41;
- a second feeding point 43, where the second feeding point 43 is electrically connected to the ground plate 11; and
- a second feeder 44, where one end of the second feeder 44 is electrically connected to the second antenna branch 22, and the other end of the second feeder 44 is electrically connected to the second feeding point 43; and the second feeding structure 6 includes:

- a third feeding point 61, where the third feeding point 61 is electrically connected to the ground plate 11;
- a third feeder 62, where one end of the third feeder 62 is electrically connected to the third antenna branch 51, and the other end of the third feeder 62 is electrically connected to the third feeding point 61;
- a fourth feeding point 63, where the fourth feeding point 63 is electrically connected to the ground plate 11; and
- a fourth feeder 64, where one end of the fourth feeder 64 is electrically connected to the fourth antenna branch 52, and the other end of the fourth feeder 64 is electrically connected to the fourth feeding point 63.

The foregoing feeding structures of the vertically polarized dipole antenna 2 and the horizontally polarized dipole antenna 5, namely, the first feeding structure 4 and the second feeding structure 6, both adopt double-ended feeding. Signal sources connected to two feeders of each feeding structure have equal amplitudes and a 180-degree phase difference, that is, the vertically polarized dipole antenna 2 and the horizontally polarized dipole antenna 5 both adopt a differential feeding manner. Differential feeding is used, so that common mode rejection capabilities and anti-interference capabilities of the antennae can be improved. In addition, end-to-end isolation of differentiation and purity of polarization can be improved. In addition, radiation power of the antenna can be higher than that of an antenna adopting a single-ended feeding structure.

It should be noted that, for a single-polarized antenna element, namely, an antenna element including only the vertically polarized dipole antenna 2, the first feeding structure 4 may also use the foregoing double-ended feeding structure. This is easy to understand. To avoid repetition, details are not described herein again.

Optionally, the two antenna branches of the vertically polarized dipole antenna 2 both adopt coaxial-line differential feeding; and the two antenna branches of the horizontally polarized dipole antenna 5 both adopt coaxial-line differential feeding.

The third feeder 62 and the fourth feeder 64 are mainly formed by connecting coaxial lines to a coplanar waveguide (CPW) and then respectively connecting the coaxial lines to the third antenna branch 51 and the fourth antenna branch 52.

In addition, in a case that a multilayer circuit substrate (LTCC) process is used for processing, in other words, when the substrate 1 includes a plurality of dielectric plates 13, a radio frequency integrated circuit (RFIC) chip can be buried in the dielectric plates 13, to directly feed electricity to the vertically polarized dipole antenna 2, thereby shortening lengths of the first feeder 42 and the second feeder 44 to reduce loss.

As mentioned above, in order to reduce horizontal space of the ground plate 11 occupied by the entire reflector 3, and to reserve more space of the ground plate 11 for other components, the entire reflector 3 may be disposed in an edge area of the ground plate 11 close to the clearance area 12.

In the foregoing disposing method, the first feeding point 41 and the second feeding point 43 are disposed on one side of the reflector 3 far away from the vertically polarized dipole antenna 2; and the third feeding point 61 and the fourth feeding point 63 are disposed on one side of the reflector 3 far away from the horizontally polarized dipole antenna 5.

In this case, the first feeder 42, the second feeder 44, the third feeder 62, and the fourth feeder 64 all need to penetrate gaps between the reflection pillars 31 of the reflector 3. Therefore, the gaps between the reflection pillars 31 can be flexibly adjusted based on an arrangement manner of the feeder.

Optionally, the first feeder 42, the second feeder 44, the third feeder 62, and the fourth feeder 64 separately penetrate a gap between two adjacent reflection pillars 31 in the middle of the reflector 3 to reach corresponding feeding points. Therefore, the gap between the two adjacent reflection pillars 31 in the middle of the reflector 3 can be increased appropriately, to ensure that the feeders can directly penetrate the gap.

Optionally, in a horizontal direction (namely, a direction parallel to the substrate 1), because the two antenna branches of the vertically polarized dipole antenna 2 are both disposed at a middle position between the two antenna branches of the horizontally polarized dipole antenna 5, the first feeder 42 and the second feeder 44 are both disposed between the third feeder 62 and the fourth feeder 64 respectively in the horizontal direction.

The following provides an implementation in which the substrate 1 includes a plurality of dielectric plates 13. The following implementation can be used for setting of each component of the foregoing dual-polarized dipole antenna.

As shown in FIGS. 2 to 7, the substrate 1 includes four dielectric plates 13.

The first antenna branch 21 is disposed in a first dielectric plate 13*a*, and penetrates the first dielectric plate 13*a*.

The first feeder 42 is disposed on a surface of a second dielectric plate 13*b* close to the first dielectric plate 13*a*.

The third antenna branch 51, the fourth antenna branch 52, the third feeder 62, the fourth feeder 64, and the ground plate 11 are all disposed on a surface of a third dielectric plate 13*c* close to the second dielectric plate 13*b*.

The second feeder 44 is disposed on a surface of a fourth dielectric plate 13*d* close to the third dielectric plate 13*c*.

The second antenna branch 22 is disposed in the fourth dielectric plate 13*d*, and penetrates the fourth dielectric plate 13*d*.

The reflector 3 penetrates the four dielectric plates 13, that is, the reflector 3 penetrates the first dielectric plate 13*a* to the fourth dielectric plate 13*d*.

Because the third antenna branch 51, the fourth antenna branch 52, and the ground plate 11 are all disposed on a same surface of a same dielectric plate 13, the ground plate 11 can be used as a reflector of the third antenna branch 51 and the fourth antenna branch 52, which can better improve reflection performance of the reflector.

Figure 6:
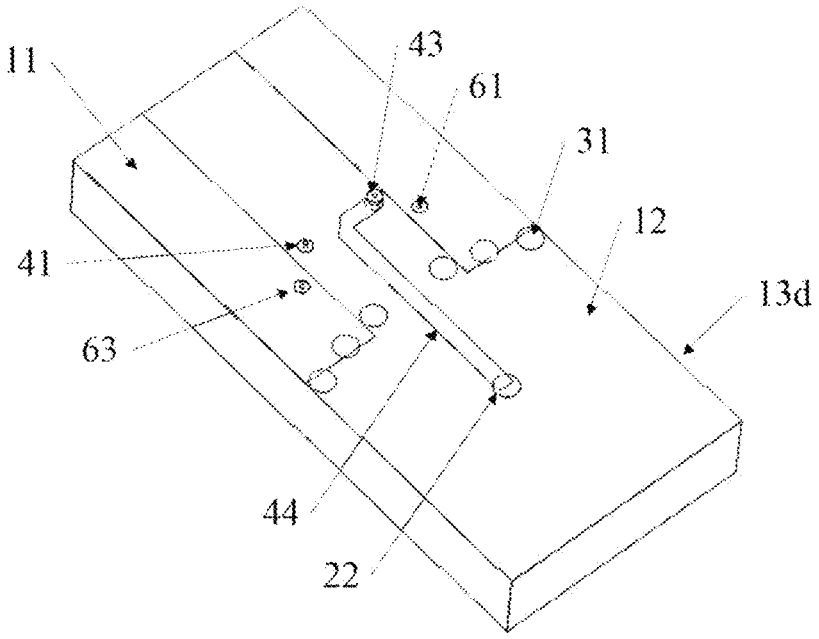

It should be noted that, in this implementation, the ground plate 11 may also be disposed on the surface of the fourth dielectric plate 13*d* close to the third dielectric plate 13*c*, in addition to being disposed on the surface of the third dielectric plate 13*c* close to the second dielectric plate 13*b*, as shown in FIG. 6. To ensure the symmetry between the ground plate 11 and each antenna branch and improve working performance of each antenna branch, the ground plate 11 may be set only on the surface of the third dielectric plate 13*c* close to the second dielectric plate 13*b*.

In addition, the substrate 1 is designed to have a structure of a plurality of dielectric plates 13. In this way, the symmetry of a dual-polarized dipole antenna can be relatively good by controlling the thickness of each dielectric plate 13. The process is simple and easy to implement.

Optionally, all the reflection pillars 31 of the reflector 3 penetrate the first dielectric plate 13*a* to the fourth dielectric plate 13*d*.

In this embodiment of the present disclosure, for a single-polarized antenna element, namely, an antenna element including only the vertically polarized dipole antenna 2, the first feeding structure 4 may further use the following single-ended feeding structure, in addition to the foregoing double-ended feeding structure.

As shown in FIGS. 17 to 20, the first feeding structure 4 includes:

- a first feeding point 41, where the first feeding point 41 is electrically connected to the ground plate 11;
- a first feeder 42, where a first end of the first feeder 42 is electrically connected to the first antenna branch 21, and a second end of the first feeder 42 is electrically connected to the first feeding point 41; and
- a second feeder 43, where a first end of the second feeder 43 is electrically connected to the second antenna branch 22, and a second end of the second feeder 43 is electrically connected to the ground plate 11 via a trapezoidal balun structure 45; and
- the first feeder 42 is coupled to the second feeder 43.

Figure 21:
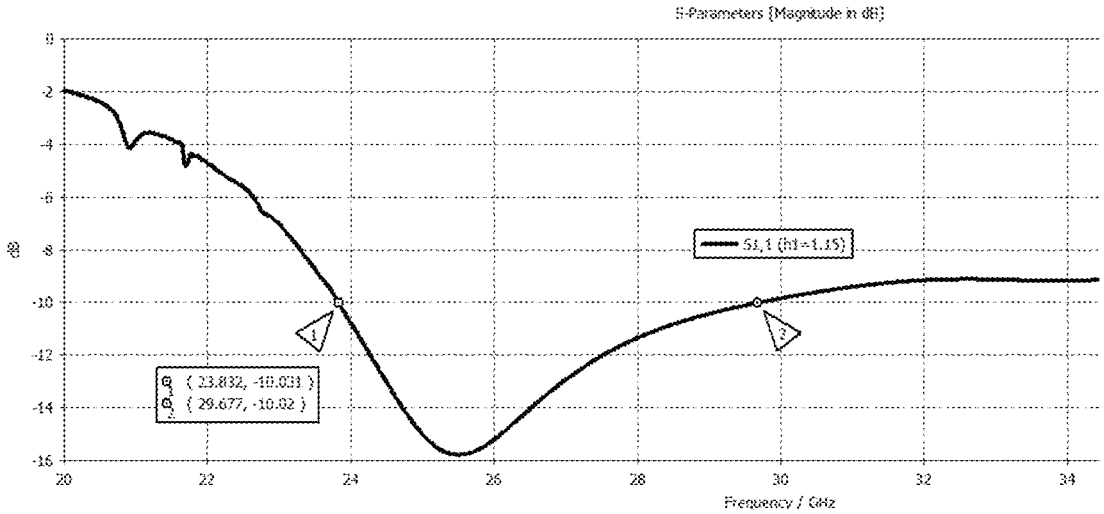
FIG. 21 is a simulated diagram of a reflection coefficient of another antenna element according to an embodiment of the present disclosure.
Figure 22:
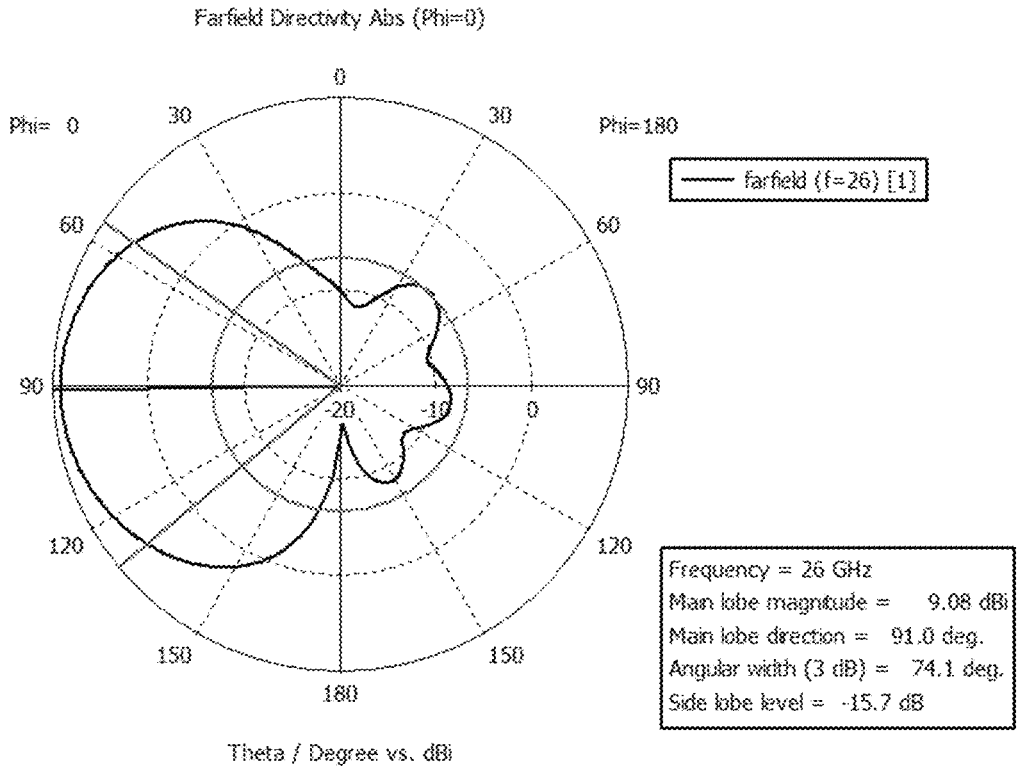
FIG. 22 is a radiation pattern of another antenna element at 26 GHz according to an embodiment of the present disclosure.
Figure 23:
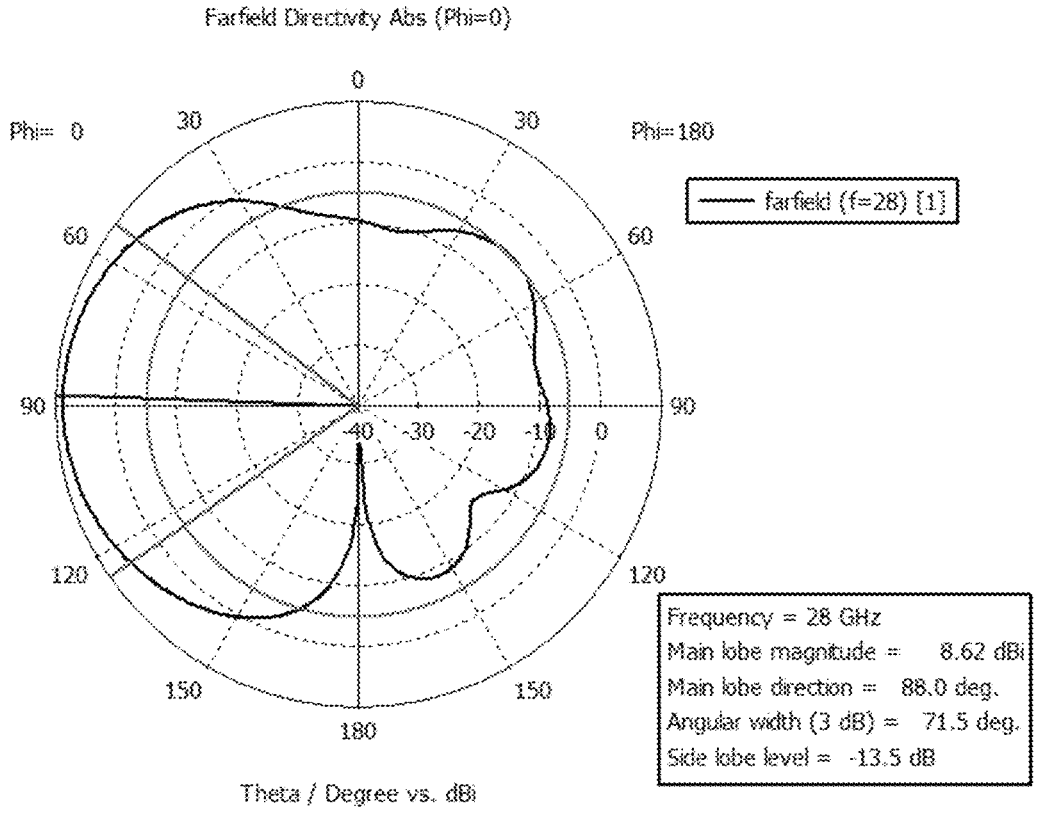
FIG. 23 is a radiation pattern of an antenna element at 28 GHz according to an embodiment of the present disclosure.

Owing to the trapezoidal balun structure 45 with an equal-amplitude and inverse-phase function, the foregoing single-ended feeding structure can implement differential feeding performance. FIG. 21 shows a reflection coefficient diagram of the vertically polarized dipole antenna 2. A bandwidth of S11 at −10 dB ranges from 23.83 GHz to 29.67 GHz, thereby basically covering the globally mainstream 5G millimeter-wave frequency bands: n257, n258, and n261 that are defined by 3GPP. FIGS. 22 and 23 respectively show radiation patterns of the vertically polarized dipole antenna 2 at frequencies of 26 GHz and 28 GHz. The maximum radiation direction of the vertically polarized dipole antenna 2 slightly deviates with relatively small offset, that is, less than 2 degrees.

In this embodiment of the present disclosure, a feeding structure of the vertically polarized dipole antenna 2 is adjusted, that is, the second antenna branch 22 of the vertically polarized dipole antenna 2 is directly grounded via the trapezoidal balun structure 45, so that only single-ended feeding is used to feed electricity to the first antenna branch 21 of the vertically polarized dipole antenna 2. Therefore, one channel can be eliminated and costs are reduced.

The following provides an implementation in which the substrate 1 includes a plurality of dielectric plates 13. The following implementation can be used for setting of each component of the foregoing single-polarized dipole antenna.

As shown in FIG. 16, the substrate 1 includes three dielectric plates 13.

The first antenna branch 21 is disposed in a first dielectric plate 13*a*, and penetrates the first dielectric plate 13*a*.

The first feeder 42 is disposed on a surface of a second dielectric plate 13*b* close to the first dielectric plate 13*a*.

The second antenna branch 22 is disposed in a third dielectric plate 13*c*, and penetrates the third dielectric plate 13*c*.

The second feeder 44 and the ground plate 11 are both disposed on a surface of the third dielectric plate 13*c* close to the second dielectric plate 13*b*.

The antenna element in this embodiment of the present disclosure can be applied to a wireless metropolitan area network (WMAN), a wireless wide area network (WWAN), a wireless local area network (WLAN), a wireless personal area network (WPAN), multiple-input multiple-output (MIMO), radio frequency identification (RFID), near field communication (NFC), wireless power consortium (WPC), frequency modulation (FM), and other wireless communication scenarios. The antenna element in this embodiment of the present disclosure can also be applied to regulatory tests, design, and application of the compatibility of an SAR, an HAC, and other wearable electronic devices related to human safety and health (such as a hearing aid or a cardiac pacemaker).

An embodiment of the present disclosure further provides an electronic device, including the antenna element according to any one of the embodiments of the present disclosure.

For related implementations of the antenna element in the electronic device, refer to the foregoing descriptions, and a same technical effect can be achieved. To avoid repetition, details are not described herein again.

Figure 24:
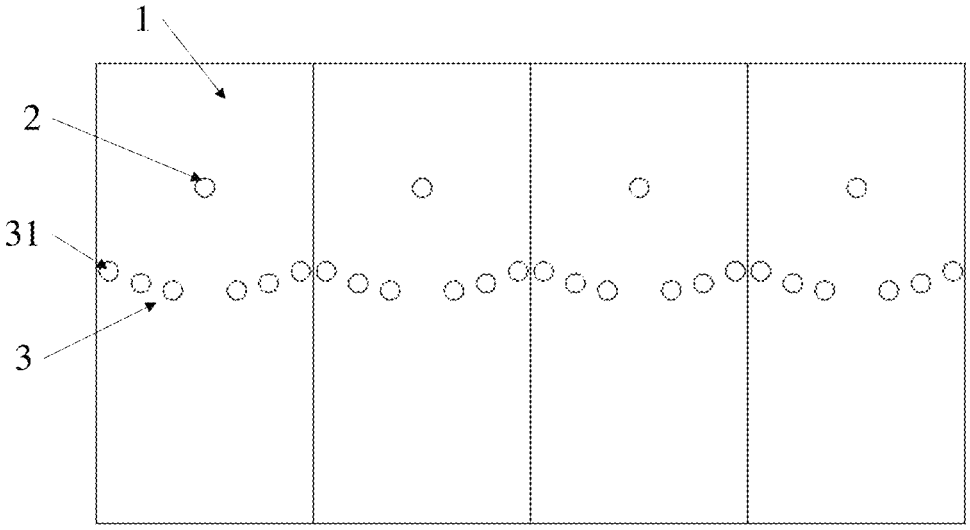
FIG. 24 is a first schematic structural diagram of an antenna array according to an embodiment of the present disclosure.

Optionally, as shown in FIG. 24, the quantity of the antenna elements is greater than or equal to 2, and the antenna elements are sequentially arranged to form an antenna array.

Figure 25:
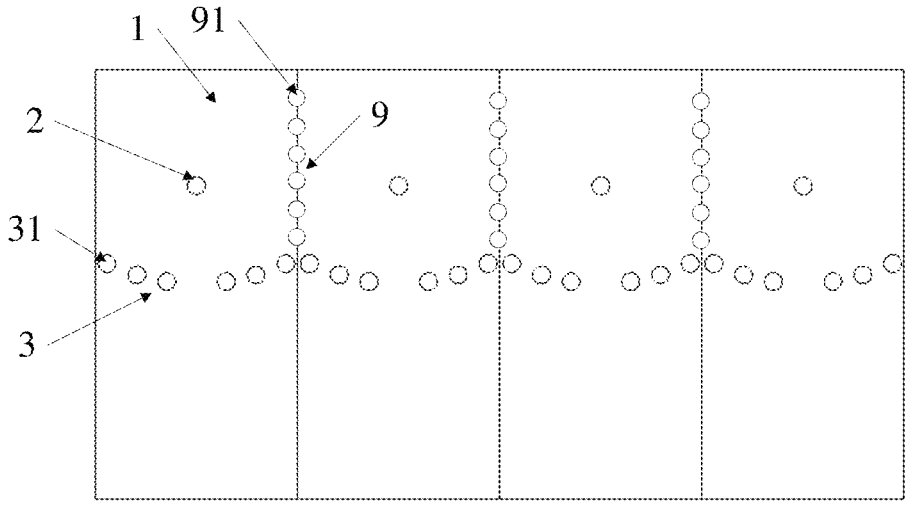
FIG. 25 is a second schematic structural diagram of an antenna array according to an embodiment of the present disclosure.

Optionally, as shown in FIG. 25, an isolator 9 is disposed between every two adjacent antenna elements.

As the isolator 9 is disposed between the adjacent antenna elements, intercoupling between the adjacent antenna elements can be effectively reduced, thereby guaranteeing working performance of the antenna array.

Optionally, the isolator 9 includes several isolation pillars 91 arranged at intervals. The isolation pillars 91 are perpendicular to the substrate 1 and penetrate the substrate 1.

The foregoing electronic device may be a computer, a mobile phone, a tablet computer, a laptop computer, a personal digital assistant (PDA), a mobile Internet device (MID), a wearable device, an e-book reader, a navigator, a digital camera, or the like.

The foregoing descriptions are merely specific implementations of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. An antenna element, comprising:

a substrate, wherein the substrate has a ground plate;

a vertically polarized dipole antenna, wherein the vertically polarized dipole antenna comprises a first antenna branch and a second antenna branch, and the first antenna branch and the second antenna branch are disposed in the substrate at an interval;

a reflector, wherein the reflector comprises several reflection pillars, and the several reflection pillars are arranged in the substrate at intervals along a parabola; and a first feeding structure, wherein the first antenna branch and the second antenna branch are electrically connected to the ground plate via the first feeding structure, wherein the first antenna branch and the second antenna branch are both disposed on a focus side of the parabola;

wherein the substrate comprises N dielectric plates, and N is greater than or equal to 3;

the first antenna branch and the second antenna branch are respectively disposed in two non-adjacent dielectric plates, and the first antenna branch and the second antenna branch respectively penetrate corresponding dielectric plates; and the several reflection pillars penetrate the N dielectric plates.

2. The antenna element according to claim 1, wherein the first antenna branch and the second antenna branch are respectively formed by metal pillars that penetrate corresponding dielectric plates; and the several reflection pillars are formed by the several metal pillars that penetrate the N dielectric plates.

3. The antenna element according to claim 1, further comprising:

a horizontally polarized dipole antenna, wherein the horizontally polarized dipole antenna comprises a third antenna branch and a fourth antenna branch, and the third antenna branch and the fourth antenna branch are disposed in the substrate at an interval;

a second feeding structure, wherein the third antenna branch and the fourth antenna branch are electrically connected to the ground plate via the second feeding structure, wherein the third antenna branch and the fourth antenna branch are both located on a focus side of the parabola; and the first antenna branch and the second antenna branch are respectively disposed on two sides of a plane where the third antenna branch and the fourth antenna branch are located, and the third antenna branch and the fourth antenna branch are respectively disposed on two sides of a plane where the first antenna branch and the second antenna branch are located.

4. The antenna element according to claim 3, wherein the first antenna branch and the second antenna branch are symmetrical to each other about the plane where the third antenna branch and the fourth antenna branch are located, and the third antenna branch and the fourth antenna branch are symmetrical to each other about the first antenna branch and the second antenna branch.

5. The antenna element according to claim 3, wherein the third antenna branch and the fourth antenna branch are both disposed in an area between the vertically polarized dipole antenna and the reflector.

6. The antenna element according to claim 3, wherein the first feeding structure comprises:

a first feeding point, wherein the first feeding point is electrically connected to the ground plate;

a first feeder, wherein one end of the first feeder is electrically connected to the first antenna branch, and the other end of the first feeder is electrically connected to the first feeding point;

a second feeding point, wherein the second feeding point is electrically connected to the ground plate; and a second feeder, wherein one end of the second feeder is electrically connected to the second antenna branch, and the other end of the second feeder is electrically connected to the second feeding point; and the second feeding structure comprises:

a third feeding point, wherein the third feeding point is electrically connected to the ground plate;

a third feeder, wherein one end of the third feeder is electrically connected to the third antenna branch, and the other end of the third feeder is electrically connected to the third feeding point;

a fourth feeding point, wherein the fourth feeding point is electrically connected to the ground plate; and a fourth feeder, wherein one end of the fourth feeder is electrically connected to the fourth antenna branch, and the other end of the fourth feeder is electrically connected to the fourth feeding point.

7. The antenna element according to claim 6, wherein the substrate comprises four dielectric plates;

the first antenna branch is disposed in a first dielectric plate, and penetrates the first dielectric plate;

the first feeder is disposed on a surface of a second dielectric plate close to the first dielectric plate;

the third antenna branch, the fourth antenna branch, the third feeder, the fourth feeder, and the ground plate are all disposed on a surface of a third dielectric plate close to the second dielectric plate;

the second feeder is disposed on a surface of a fourth dielectric plate close to the third dielectric plate;

the second antenna branch is disposed in the fourth dielectric plate, and penetrates the fourth dielectric plate; and the reflector penetrates the four dielectric plates.

8. The antenna element according to claim 1, wherein the first feeding structure comprises:

a first feeding point, wherein the first feeding point is electrically connected to the ground plate;

a first feeder, wherein a first end of the first feeder is electrically connected to the first antenna branch, and a second end of the first feeder is electrically connected to the first feeding point; and a second feeder, wherein a first end of the second feeder is electrically connected to the second antenna branch, and a second end of the second feeder is electrically connected to the ground plate via a trapezoidal balun structure, wherein the first feeder is coupled to the second feeder.

9. The antenna element according to claim 8, wherein the substrate comprises three dielectric plates;

the first antenna branch is disposed in a first dielectric plate, and penetrates the first dielectric plate;

the first feeder is disposed on a surface of a second dielectric plate close to the first dielectric plate;

the second antenna branch is disposed in a third dielectric plate, and penetrates the third dielectric plate; and the second feeder, the trapezoidal balun structure, and the ground plate are all disposed on a surface of the third dielectric plate close to the second dielectric plate.

10. The antenna element according to claim 1, wherein a central axis of the first antenna branch and a central axis of the second antenna branch both penetrate a focus of the parabola.

11. The antenna element according to claim 3, wherein at least one of the vertically polarized dipole antenna or the horizontally polarized dipole antenna is a millimeter-wave antenna.

12. An electronic device, comprising at least two antenna elements, wherein one of the at least two antenna elements comprises:

a substrate, wherein the substrate has a ground plate;

a vertically polarized dipole antenna, wherein the vertically polarized dipole antenna comprises a first antenna branch and a second antenna branch, and the first antenna branch and the second antenna branch are disposed in the substrate at an interval;

a reflector, wherein the reflector comprises several reflection pillars, and the several reflection pillars are arranged in the substrate at intervals along a parabola; and a first feeding structure, wherein the first antenna branch and the second antenna branch are electrically connected to the ground plate via the first feeding structure, wherein the first antenna branch and the second antenna branch are both disposed on a focus side of the parabola;

wherein the substrate comprises N dielectric plates, and N is greater than or equal to 3;

the first antenna branch and the second antenna branch are respectively disposed in two non-adjacent dielectric plates, and the first antenna branch and the second antenna branch respectively penetrate corresponding dielectric plates; and the several reflection pillars penetrate the N dielectric plates.

13. The electronic device according to claim 12, wherein the at least two antenna elements are sequentially arranged to form an antenna array.

14. The electronic device according to claim 12, wherein the first antenna branch and the second antenna branch are respectively formed by metal pillars that penetrate corresponding dielectric plates; and the several reflection pillars are formed by the several metal pillars that penetrate the N dielectric plates.

15. The electronic device according to claim 12, wherein the one of the at least two antenna elements further comprises:

a horizontally polarized dipole antenna, wherein the horizontally polarized dipole antenna comprises a third antenna branch and a fourth antenna branch, and the third antenna branch and the fourth antenna branch are disposed in the substrate at an interval;

a second feeding structure, wherein the third antenna branch and the fourth antenna branch are electrically connected to the ground plate via the second feeding structure, wherein the third antenna branch and the fourth antenna branch are both located on a focus side of the parabola; and the first antenna branch and the second antenna branch are respectively disposed on two sides of a plane where the third antenna branch and the fourth antenna branch are located, and the third antenna branch and the fourth antenna branch are respectively disposed on two sides of a plane where the first antenna branch and the second antenna branch are located.

16. The electronic device according to claim 15, wherein the first feeding structure comprises:

a first feeding point, wherein the first feeding point is electrically connected to the ground plate;

a first feeder, wherein one end of the first feeder is electrically connected to the first antenna branch, and the other end of the first feeder is electrically connected to the first feeding point;

a second feeding point, wherein the second feeding point is electrically connected to the ground plate; and a second feeder, wherein one end of the second feeder is electrically connected to the second antenna branch, and the other end of the second feeder is electrically connected to the second feeding point; and the second feeding structure comprises:

a third feeding point, wherein the third feeding point is electrically connected to the ground plate;

a third feeder, wherein one end of the third feeder is electrically connected to the third antenna branch, and the other end of the third feeder is electrically connected to the third feeding point;

a fourth feeding point, wherein the fourth feeding point is electrically connected to the ground plate; and a fourth feeder, wherein one end of the fourth feeder is electrically connected to the fourth antenna branch, and the other end of the fourth feeder is electrically connected to the fourth feeding point.

17. The electronic device according to claim 12, wherein the first feeding structure comprises:

a first feeding point, wherein the first feeding point is electrically connected to the ground plate;

a first feeder, wherein a first end of the first feeder is electrically connected to the first antenna branch, and a second end of the first feeder is electrically connected to the first feeding point; and a second feeder, wherein a first end of the second feeder is electrically connected to the second antenna branch, and a second end of the second feeder is electrically connected to the ground plate via a trapezoidal balun structure, wherein the first feeder is coupled to the second feeder.

18. The electronic device according to claim 12, wherein a central axis of the first antenna branch and a central axis of the second antenna branch both penetrate a focus of the parabola.

* * * * *